United States Patent [19]

Krug et al.

[11] 3,966,623

[45] June 29, 1976

[54] CORROSION INHIBITED LUBE OIL COMPOSITIONS

[75] Inventors: Robert H. Krug, Cornwall; Clemence J. Henry, Newburgh, both of N.Y.

[73] Assignee: Texaco Inc., New York, N.Y.

[22] Filed: June 5, 1975

[21] Appl. No.: 584,243

[52] U.S. Cl. ..... 252/47; 252/391

[51] Int. Cl.[2] ..... C10M 1/38; C10M 3/32; C10M 5/28; C10M 7/36

[58] Field of Search ..... 252/47, 391

[56] References Cited

UNITED STATES PATENTS

| | | | |
|---|---|---|---|
| 3,525,691 | 8/1970 | McConnell | 252/47 |
| 3,537,999 | 11/1970 | Kennedy | 252/47 |
| 3,663,561 | 5/1972 | Blaha | 252/47 |
| 3,775,321 | 11/1973 | Qurnquest | 252/47 |

*Primary Examiner*—Delbert E. Gantz
*Assistant Examiner*—I. Vaughn
*Attorney, Agent, or Firm*—Thomas H. Whaley; Carl G. Ries; Robert A. Kulason

[57] ABSTRACT

A lubricating oil composition containing a synergistic corrosion inhibiting combination of 2,5-bis-hydrocarbyldithio-1,3,4-thiadiazole and a primary alkyl or alkenyl amine salt of 2-mercaptobenzothiazole.

6 Claims, No Drawings

CORROSION INHIBITED LUBE OIL COMPOSITIONS

BACKGROUND OF INVENTION

In the operation of machinery there is a continual raising of performance standards of lubricating compositions therefor with an objective of extending the life of the lubricating composition and/or improving its performance under severe operating conditions. One of the areas under particular scrutiny is in the area of the lubrication of gears, gear trains, bearings and the like, particularly the gear mechanisms in the differential of automobiles. One of the principal targets for improvement is the anticorrosive properties of the lubricating oil since many of the other additives performing antioxidant, VI, detergent dispersancy, load carrying and lubricity functions are often corrosive in themselves and/or break down during use into corrosive substances which result in severe corrosive attack of the lubricated machinery surface, e.g., gear surfaces, which undesirably results in their premature replacement.

SUMMARY OF INVENTION

We have discovered and this constitutes our invention the anticorrosive properties of hydrocarbon lubricating oil can be unexpectedly synergistically improved, particularly in respect to copper metal surfaces by incorporation therein of a combination of an alkenyl or alkyl primary amine derivative salt of 2-mercaptobenzothiazole, and 2,5-bis-hydrocarbyldithio-1,3,4-thiadiazole.

DETAILED DESCRIPTION OF THE INVENTION

Specifically, in the finished hydrocarbon lubricating oil compositions suitable for use, the content of the amine salt and thiadiazole components are respectively of between about 0.01 and 5.0 wt. % and between about 0.01 and 5.0 wt. %. Preferably, finished compositions contain between 0.05 and 0.5 of the amine salt and between 0.05 and 0.2 wt. % of the thiadiazole. The concentrate form of the finished lubricating oil compositions are suitable for storage and transportation. The concentrate is converted into the finished form by dilution with additional hydrocarbon lubricating oil. The concentrate normally contains between about 5 and 25 wt. % of the amine salt and between about 5 and 25 wt. % of the thiadiazole.

Examples of the hydrocarbon oil base contemplated in the finished and concentrate formulations of the invention are mineral lubricating oils such as paraffinic lube oil, naphthenic lube oil and mixtures thereof. Other suitable hydrocarbon oils are those synthetically formed such as the polyalkylene, e.g., polyisobutylene of a molecular weight of about 1,000 and 5,000. The particular base oils employed in respect to viscosity will be dependent upon the particular use intended for the finished formulation. However, SUS viscosities of the base oils employed will generally range between about 70 and 5,000 at 100°F., preferably between about 100 and 3,000. The base oils in concentrate and finished compositions constitute a major amount thereof, i.e., at least about 50 wt. %. More specifically, the base oils in the fully formulated finished formulations normally constitute at least about 85 and up to 99+ wt. % thereof, preferably between 90 and 95 wt. %. In concentrate compositions base oils are normally present in amounts of between about 10 and 50 wt. %.

The amine salt derivative of the mercaptobenzothiazole of the synergistic corrosion inhibiting combination in the contemplated formulations of the invention can be characterized by the formula:

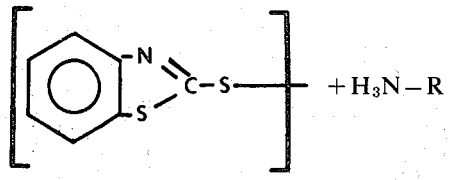

where R is alkyl or alkenyl of from 4 to 30 carbons. Specific examples of the contemplated mercaptobenzothiazoles are where R is butyl, amyl, hexyl, octyl, octenyl, lauryl, oleyl, octadecyl and eicosyl.

Mixtures of amine salts of the 2-mercaptobenzothiazole are also contemplated and are usually the result of the reaction of 2-mercaptobenzothiazole with an alkyl or alkenyl primary amine mixtures. Particularly suitable amines to form the amine salt mixtures are those sold by Rohm and Haas under the tradename Primene JM-T and Primene 81-R. Primene 81-R and Primene JM-T are mixtures of highly branched tertiary alkyl primary amines where the alkyl configuration is essentially a repeating t-butyl group. The Primene 81-R alkyl groups have a carbon range from 11 to 14 carbons and the Primene JM-T have a carbon range of 18 to 22 carbons. Another suitable amine mixture is Armeen 0 a product of Armak Company, comprising about 75 wt. % oleyl amine and the remainder essentially mono and polyunsaturated $C_{14}$ to $C_{18}$ amine mixture.

The other half of the synergistic corrosion inhibiting combination of the formulations contemplated herein, i.e., 2,5-bis-hydrocarbyldithio-1,3,4-thiadiazole is characterized by the formula:

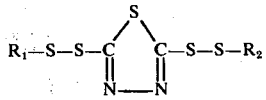

where $R_1$ and $R_2$ are alkyl or alkenyl of from 4 to 30 carbons. Specific examples of the thiadiazoles contemplated herein are where $R_1$ and $R_2$ are n-butyl, t-butyl, octyl, 2-ethylhexyl octenyl, isooctyl, decyl, isodecyl, lauryl, oleyl, and eicosyl. A particularly preferred thiadiazole is where $R_1$ and $R_2$ are octyl.

In addition to the hydrocarbon oil and the amine salt-thiadiazole synergistic corrosion inhibiting combination in the contemplated oil compositions other additives are normally employed, the particular additives utilized being dependent on the specific service intended for the finished compositions of the invention. Some of the other additives contemplated belong in classes of detergent-dispersants, pour depressants, VI improvers, extreme pressure agents, antiwear agents, antioxidants, supplementary corrosion inhibitors and antifoamants.

Examples of the extreme pressure and antiwear agents are dithiolethinone derived from sulfurizing triisobutylene and alkylsulfides, disulfides and polysulfides, prepared by the sulfurization of isobutylene with sulfur dichloride. Other extreme pressure and antiwear agents contemplated are the sulfurized terpenes, sulfurized hydrocarbon oils and polyalkylsulfides, all of which contain active sulfur or sulfur compounds which are corrosive to copper. A particularly preferred extreme pressure and antiwear agent is sulfurized triisobutylene. These extreme pressure and antiwear agents are normally present in the finished formulations (when utilized) in amounts of between about 0.1 and 10 wr. %, preferably between 0.5 and 5 wt. %.

Examples of contemplated viscosity index improvers which may in many instances also function as pour depressors are the methacrylate ester polymers characterized by the general formula:

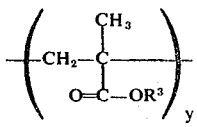

where $R^3$ is an alkyl group, a dimethylamino group or mixtures of said groups containing from 1 to 20 carbons and $y$ is an integer providing a molecular weight of the polymer in the range of 25,000 to 1,250,000, preferably 50,000 to 500,000. Methacrylate ester polymers possessing pour point depressant as well as viscosity index improving properties are well known, e.g., U.S. Pat. No. 2,737,496. One effective material of this type is the tetrapolymer butyl, lauryl, stearyl and dimethylaminoethyl methacrylate in approximate ratios of 1:2:1:0.2. Other particularly suitable VI improvers are the copolymers of lauryl and stearyl methacrylate moieties having a respective weight ratio of 3:1. The methacrylate ester is advantageously employed in the base oils in amounts ranging from 0.1 to 10 wt. %, preferably between 0.2 and 5.0 wt. %, in order to impart the desired viscosity index and/or pour point thereto.

When detergent-dispersants are employed, they are usually utilized in amounts of between about 0.5 and 5 wt. %. Examples of ashless dispersants are alkenyl succinimides characterized by the general formula:

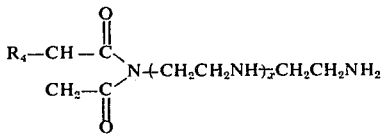

where $R_4$ is monoolefinic aliphatic hydrocarbon of from about 50 to 200 carbons and $x$ is an integer of from about 1 to 10 derived from alkenyl succinic anhydride and polyethylene polyamine. Particularly suitable derivatives are the diethylenetriamine, triethylene tetramine, tetraethylene pentamine derivatives of polyisobutylene succinic anhydride, particularly where $R_4$ is of a molecular weight between about 700 and 2000, e.g., about 1300. These ashless dispersants are further described in U.S. Pat. Nos. 3,172,892 and 3,202,678. The non ashless dispersants which may be utilized are the alkaline earth metal overbased calcium alkaryl sulfonates such as calcium carbonate, overbased calcium alkaryl sulfonate, where the alkaryl sulfonate moiety is of a molecular weight of 500 to 1000. These overbased sulfonates are further described in U.S. Pat. Nos. 3,027,325 and 3,312,618 and 3,537,996.

Examples of suitable antioxidants which often also function as supplementary corrosion inhibitors are the aryl substituted amine compounds exemplified by phenylnaphthylamine as well as compounds such as phenylenediamine, phenathiazine, diphenylamine employed in amounts of 0.1 and 5 wt. %. Specific examples are the phenylalphanaphthyl amines and a mixture of 2,2-diethyl-4,4'-t-dioctyldiphenyleneamine and 2,2'-diethyl-4,6-diphenylamine. Other suitable antioxidants are long chain alkyl amines such as Primene JM-T and 81R.

Suitable supplementary corrosion inhibitors are the alkyl dihydrogen phosphates and the dialkyl hydrogen phosphates such as the mixtures of dodecyl dihydrogen phosphate and didodecyl hydrogen phosphate and Armeen 0, the latter also functioning as a lubricity agent.

Examples of the contemplated antifoamants are the silicone polymers such as polymeric dimethyl silicone. These antifoamants are employed in amounts of between about 10 and 500 ppm.

The following examples further illustrate the invention but are not to be construed as limitations thereof.

EXAMPLE I

This example illustrates the compositions of the invention and the unexpected synergistic action in reducing corrosion of the amine salt-thiadiazole combination contemplated herein.

Five test formulations were prepared, Formulation A being a representative formulation and Formulations B, C, D and E being comparative formulations. Each formulation was subjected to a copper strip corrosion test where a copper strip is placed for a 3 hour period in the test composition maintained at a temperature of 250°F. At the end of the 3 hour period, the strip is withdrawn and the degree of corrosive attack upon the strip is measured using a rating ranging from 1*a* to 4*c* with the rating of 1*a* representing the least corrosive attack and a rating of 4*c* representing the greatest corrosive attack.

The test formulations and the corrosion test data are reported below in Table 1:

TABLE 1

| Composition, Wt. % | A | B | C | D | E |
|---|---|---|---|---|---|
| Mineral Oil, 1000 SUS at 100°F. | 90.4 | 90.5 | 90.4 | 90 | 90.4 |
| $Na_2S$ - Sulfurized Diisobutylene (30 wt. % S) | 7.0 | 7.0 | 7.0 | 7.0 | 7.0 |
| Ethyl Oleyl Acid Orthophosphate | 1.0 | 1.0 | 1.0 | 1.0 | 1.0 |
| Prime Lard Oil | 0.5 | 0.5 | 0.5 | 0.5 | 0.5 |
| Amine Salt* | 0.5 | 0.5 | 0.6 | — | — |
| Thiadiazole** | 0.1 | — | — | 0.1 | 0.6 |
| Polymethacrylate*** | 0.5 | 0.5 | 0.5 | 0.5 | 0.5 |
| Dimethyl Silicone Polymer; ppm | 100 | 100 | 100 | 100 | 100 |

TABLE 1-continued

| Composition, Wt. % | A | B | C | D | E |
|---|---|---|---|---|---|
| Test | | | | | |
| Corrosion CS | | | | | |
| 3 Hr/250°F. | 1b | 4c | 4a | 4b | 3a |

*Primene JM-T salt of 2-mercaptobenzothiazole
**2,5-bis-dioctyldithio-1,3,4-thiadiazole
***35 wt. % mineral oil solution of terpolymer of butyl, lauryl, stearyl and dimethylaminoethyl methacrylates in a weight ratio of 20:55:20:5 of an intrinsic viscosity in benzene (77°F) of about 0.73.

As can be seen from a comparison of the corrosion inhibitor of representative Composition A with comparative Compositions B, C, D and E, the amine salt-thiadiazole combination results in a synergistic improvement in respect to inhibiting copper corrosion.

EXAMPLE II

This example further illustrates the contemplated compositions of the invention and the synergism of the amine salt-thiadiazole ingredient combination in respect to inhibiting corrosion.

Composition 2573 is the base composition. Composition 2684 is the representative composition and Compositions 2683 and 2694 are comparative compositions. A description of the compositions and the resultant Copper Strip Corrosion Test data is reported below in Table 2.

TABLE 2

| Composition, Wt. % | 2573 | 2683 | 2684 | 2694 |
|---|---|---|---|---|
| Mineral Oil (90 SUS at 210°F) | 92.4 | — | — | — |
| Sulfurized Isobutylene | 4.0 | — | — | — |
| Mix of Dodecyl Dihydrogen Phospate - Didodecyl Hydrogen Phosphate | 1.5 | — | — | — |
| Oleylamine | 0.8 | — | — | — |
| Primene 81-R | 0.5 | — | — | — |
| Polymethacrylate* | 0.8 | — | — | — |
| Dimethyl Silicone Polymer, ppm | 100 | — | — | — |
| Composition 2573 | — | 99.8 | 99.8 | 99.8 |
| Thiadiazole** | — | 0.1 | 0.1 | — |
| Amine Salt*** | — | — | 0.1 | 0.1 |
| Di-n-octylthiourea | — | 0.1 | — | 0.1 |
| Test | | | | |
| CS Corr. (3 hr/250°F) | 4a | 3a | 1b | 3b |

*35 wt. % mineral oil solution of terpolymer of butyl, lauryl, stearyl and dimethylaminoethyl methacrylates in a weight ratio of 20:55:20:5 of an intrinsic viscosity in benzene (77°F) of about 0.73.
**2,5-bis-octyldithio-1,3,4-thiadiazole
***Primene JM-T salt of 2-mercaptobenzothiazole

EXAMPLE III

This example still further illustrates the contemplated compositions of the invention and the synergism of the amine salt-thiadiazole ingredient combination in inhibiting corrosion.

Composition 3489 is the base composition. Compositions 4030, 2567, 2521 and 2568 are comparative compositions. Compositions 2523, 2524, 2504, 2505, 2506 and 2507 are examples of representative compositions of the invention. A description of the compositions and the resultant Copper Strip Corrosion Test data is reported below in Table 3.

TABLE 3

| Composition, Wt. % | 3489 | 4030 | 2567 | 2521 | 2568 | 2523 | 2524 | 2504 | 2505 | 2506 | 2507 |
|---|---|---|---|---|---|---|---|---|---|---|---|
| Mineral Oil (90 SUS-210°F) | 92.4 | — | — | — | — | — | — | — | — | — | — |
| Sulfurized Isobutylene | 4.0 | — | — | — | — | — | — | — | — | — | — |
| Mix of Dodecyl Dihydrogen-Didodecyl Hydrogen Phosphate | 1.5 | — | — | — | — | — | — | — | — | — | — |
| Oleylamine | 0.8 | — | — | — | — | — | — | — | — | — | — |
| Primene 81-R | 0.5 | — | — | — | — | — | — | — | — | — | — |
| Polymethacrylate* | 0.8 | — | — | — | — | — | — | — | — | — | — |
| Dimethyl Silicone Polymer, ppm | 100 | — | — | — | — | — | — | — | — | — | — |
| Composition 3489 | — | 99.9 | 99.85 | 99.9 | 99.85 | 99.85 | 99.85 | 99.8 | 99.7 | 99.6 | 99.5 |
| Thiadiazole** | — | 0.1 | 0.15 | — | — | 0.10 | 0.05 | 0.1 | 0.1 | 0.1 | 0.1 |
| Amine Salt*** | — | — | — | 0.1 | 0.15 | 0.05 | 0.10 | 0.1 | 0.2 | 0.3 | 0.4 |
| Test | | | | | | | | | | | |
| CS Corr. (3 hr./259°F) | 3b | 3b | 3b | 3b | 3b | 3b | 1b | 1b | 1b | 1b | 1b |

*35 wt. % mineral oil solution of terpolymer of butyl, lauryl, stearyl and dimethylaminoethyl methacrylates in a weight ratio of 20:55:20:5 of an intrinsic viscosity in benzene (77°F) of about 0.73.
**2,5-bis-dioctyldithio-1,3,4-thiadiazole
***Primene JM-T salt of 2-mercaptobenzothiazole.

We claim:

1. A composition comprising a major amount of hydrocarbon oil of lubricating viscosity and between about 0.01 and 25 wt. % of an amine salt of 2-mercaptobenzothiazole characterized by the formula:

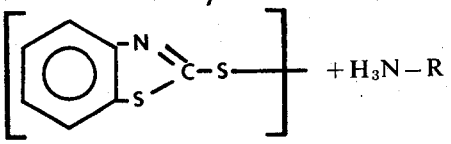

where R is alkyl or alkenyl of between about 4 and 30 carbons and between about 0.01 and 25.0 wt. % of a thiadiazole characterized by the formula:

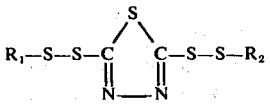

where $R_1$ and $R_2$ are alkyl or alkenyl of from 4 to 30 carbons.

2. A composition in accordance with claim 1 wherein said amine salt is present in an amount between about 0.01 and 5 wt. % and said thiadiazole is present in an amount of between about 0.01 and 5 wt. %.

3. A composition in accordance with claim 1 wherein said amine salt is present in an amount of between about 5 and 25 wt. % and said thiadiazole is present in an amount between about 5 and 25 wt. %.

4. A composition in accordance with claim 2 wherein said amine is a mixture with R being tertiary alkyl of 12 to 14 carbons and $R_1$ and $R_2$ are octyl.

5. A composition in accordance with claim 2 wherein R is tertiary alkyl ranging from 18 to 22 carbons and $R_1$ and $R_2$ are octyl.

6. A composition in accordance with claim 2 wherein R is oleyl and $R_1$ and $R_2$ are octyl.

* * * * *